US008863561B2

(12) United States Patent
Orlov et al.

(10) Patent No.: US 8,863,561 B2
(45) Date of Patent: Oct. 21, 2014

(54) DOOR STOP WITH SECURITY LOCK

(71) Applicants: Adam Orlov, Chicago, IL (US); Stuart Mitchell, St. Paul, MN (US)

(72) Inventors: Adam Orlov, Chicago, IL (US); Stuart Mitchell, St. Paul, MN (US)

( * ) Notice: Subject to any disclaimer, the term of this patent is extended or adjusted under 35 U.S.C. 154(b) by 9 days.

(21) Appl. No.: 13/861,215

(22) Filed: Apr. 11, 2013

(65) Prior Publication Data

US 2014/0182341 A1 Jul. 3, 2014

Related U.S. Application Data

(60) Provisional application No. 61/747,528, filed on Dec. 31, 2012.

(51) Int. Cl.
*E05F 5/02* (2006.01)
*E05C 19/18* (2006.01)

(52) U.S. Cl.
CPC ..... *E05C 19/182* (2013.01); *Y10S 292/15* (2013.01); *Y10S 292/17* (2013.01)
USPC ..... 70/14; 16/86 B; 16/375; 70/91; 70/93; 70/94; 70/101; 49/383; 49/384; 292/288; 292/297; 292/339; 292/343; 292/DIG. 15; 292/DIG. 17

(58) Field of Classification Search
CPC ..... E05B 67/36; E05B 9/084; E05B 65/0007; E05C 19/003; E05C 19/184; E05C 17/365; E05C 17/166; E05C 17/32; E05C 17/00; E05C 17/02; E05C 19/004; E05C 9/043
USPC ..... 70/14, 91, 93, 94, 101, DIG. 17, 58; 292/288, 297, 338, 339, 342, 343, 292/DIG. 15, DIG. 17; 16/82, 86 B, 375; 49/383, 384; D8/330, 331, 336–338, D8/400, 402, 403
See application file for complete search history.

(56) References Cited

U.S. PATENT DOCUMENTS

| | | | | |
|---|---|---|---|---|
| 1,664,174 | A * | 3/1928 | Hoopes, Jr. | 292/344 |
| 3,844,145 | A * | 10/1974 | Kneebone | 70/90 |
| D286,015 | S | 10/1986 | Johnson | |
| 4,831,688 | A | 5/1989 | Deininger | |

(Continued)

FOREIGN PATENT DOCUMENTS

| | | | |
|---|---|---|---|
| GB | 194965 | A | 3/1923 |
| GB | 484827 | A | 5/1938 |
| WO | 9927217 | A1 | 6/1999 |

OTHER PUBLICATIONS

International Search Report and Written Opinion for PCT/US13/75640 dated May 14, 2014.

*Primary Examiner* — Lloyd Gall
(74) *Attorney, Agent, or Firm* — Levenfeld Pearlstein, LLC

(57) ABSTRACT

A door stop includes a body having a longitudinal axis and having angled sides defining an apex. A rotating toggle having angled sides defining an apex and a longitudinal axis is operably connected at its apex to the body at about the apex of the body. The toggle is rotatable such that the longitudinal axis of the toggle aligns with the longitudinal axis of the body in an insertion position and the longitudinal axis of the toggle is transverse to the longitudinal axis of the body in a locked position. A lock assembly is operably mounted to the body to lock the toggle in the locked position.

13 Claims, 8 Drawing Sheets

(56) References Cited

U.S. PATENT DOCUMENTS

| | | | | |
|---|---|---|---|---|
| 4,878,267 | A * | 11/1989 | Roach et al. | 16/250 |
| 5,027,471 | A | 7/1991 | Barnes | |
| 5,450,652 | A | 9/1995 | Webb | |
| 5,509,235 | A | 4/1996 | Chander | |
| 5,511,837 | A | 4/1996 | Dempsey et al. | |
| 5,711,557 | A | 1/1998 | Nicolosi | |
| 6,170,304 | B1 * | 1/2001 | Ohta | 70/14 |
| D455,644 | S | 4/2002 | Coffey | |
| D538,149 | S | 3/2007 | Yarde et al. | |
| 7,374,213 | B2 | 5/2008 | Carlson | |
| 7,506,905 | B1 | 3/2009 | George | |
| 7,559,114 | B2 | 7/2009 | Ranilovich | |
| D603,694 | S | 11/2009 | Bushey | |
| D604,156 | S | 11/2009 | Healy | |
| 7,786,884 | B1 * | 8/2010 | McRoskey | 340/686.1 |
| 7,904,992 | B2 | 3/2011 | Agster et al. | |
| 8,215,140 | B1 | 7/2012 | Gaines | |
| 2005/0161954 | A1 | 7/2005 | Miskin | |
| 2007/0126248 | A1 | 6/2007 | Mintz | |
| 2008/0277949 | A1 | 11/2008 | Emde et al. | |
| 2009/0260182 | A1 | 10/2009 | Hall | |
| 2010/0038921 | A1 | 2/2010 | Kirkham et al. | |
| 2010/0175324 | A1 | 7/2010 | Cress | |
| 2011/0254293 | A1 | 10/2011 | Duff et al. | |
| 2012/0043770 | A1 | 2/2012 | Lau | |
| 2012/0227448 | A1 | 9/2012 | Su | |

* cited by examiner

DOOR STOP WITH SECURITY LOCK

BACKGROUND OF THE INVENTION

The present invention relates generally to a door stop and more particularly, to a door stop with a security lock to prevent inadvertent or unwanted closure of the door.

Door security for cleaning staff, nurses, realtors and the like in hotels, spas, hospitals and residences is essential. Most doors have locking systems barring unauthorized entry, especially forced entry. The greater protection against forced entry, the greater security enjoyed by the inhabitants. However, for cleaning staff, nurses and the like, these locking systems can be used against them by a perpetrator who locks the door behind them and uses the secured space to physically attack the victim. Once the door is locked, the locking system is no longer accessible from the outside and, therefore, cannot be opened from the outside by another to aid or protect the victim against the perpetrator. Therefore, in these types of situations it is desirable to secure complete opening of the door, and retain protection against forced closure of the door and unwanted creation of a closed or confined space.

Furthermore, a door security device to prevent a door completely or partially closing relative to a door frame is desirable in locations where egress access must be maintained or to prevent inadvertent injury to individuals, such as children and the like, in the closing of doors relative to a door frame structure.

As such, it will be appreciated that there is a need for a new and improved door stop. Desirably, such a door stop can be securely placed relative to a door frame to prevent complete or partial closure of the door and which cannot be easily removed by another. More desirably, such a door stop apparatus has a lock assembly to secure the door stop between the door and door jamb.

SUMMARY

A door stop includes a body having a longitudinal axis and angled sides defining an apex. A rotating toggle also has angled sides defining an apex. The toggle is operably connected at its apex to the body at about the apex of the body.

The toggle is rotatable such that the angled sides of the toggle align with the longitudinal axis of the body in an insertion position to insert the door stop between a door and a door jamb, and such that the toggle angled sides are transverse to the longitudinal axis of the body in a locked position.

A lock assembly is operably mounted to the body to lock the toggle in the locked position. The lock assembly is mounted within the body and a stub extends between and connects the lock assembly and the toggle. The stub extends from about the apex of the body to about the apex of the toggle.

The lock assembly can be of a key lock having a key. The key can be removable from the key lock to lock the toggle in the locked position. The key can be rotatable to rotate the toggle.

The door stop can include a hook extending from a rear of the body. The hook is configured to cooperate with a hinge that mounts a door to a door frame. The hook can include a cut-out to accommodate the toggle when the toggle is in the insertion position.

A holding region can be formed on a front of the body. The holding region is defined between a cover and the body. The holding region can be formed opposite the hook.

These and other features and advantages of the present invention will be apparent from the following detailed description, in conjunction with the appended claims.

DETAILED DESCRIPTION

While the present device is susceptible of embodiment in various forms, there is shown in the figures and will hereinafter be described a presently preferred embodiment with the understanding that the present disclosure is to be considered an exemplification of the device and is not intended to be limited to the specific embodiment illustrated.

Figure 1:
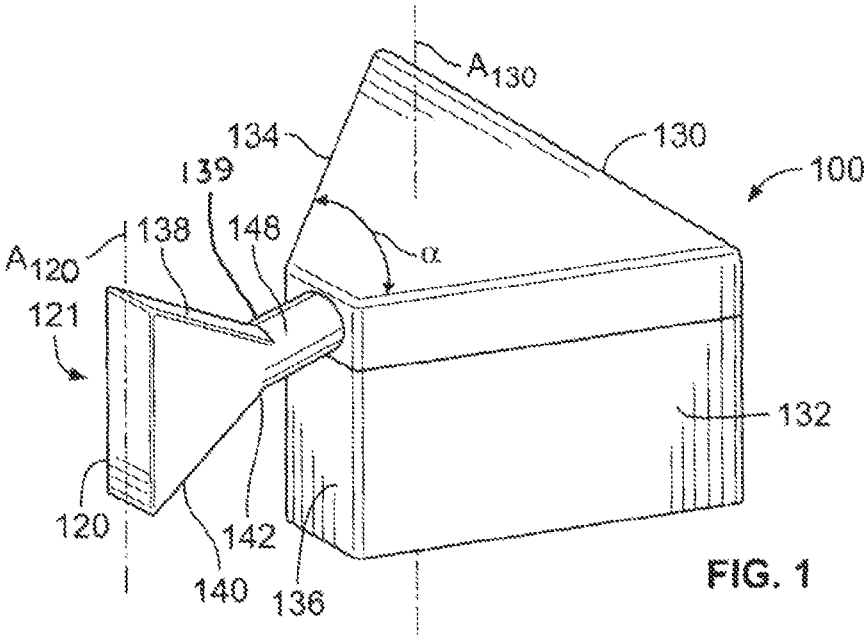
FIG. 1 is a perspective view of an embodiment of a door stop.

Turning now descriptively to the drawings, in which similar reference characters denote similar elements throughout the several views, FIGS. 1 *through* 7 illustrate an embodiment of an improved door stop.

The door stop 100 includes a body 130 and a rotating toggle 120. In an embodiment, the body 130 has a triangular wedge shaped body having a pair of sides 132, 134 formed at an angle $\alpha$ to one another. In the illustrated embodiment, the angle $\alpha$ is an acute angle. It will be appreciated that the body 130 is configured to fit between an inside surface S1 of a door D and a corresponding surface S2 of a door jamb J. The door and jamb surfaces S1, S2 typically form an acute angle ranging from about 0 degrees (when the door D is closed) to about 90 degrees when the door D is open. It will, however, be understood that the angle formed by the open door D can vary greatly from just a few degrees (slightly ajar) to close to 180 degrees when fully swept open, depending upon the type and placement of the hinges 210 mounting the door D to the jamb J. For purposes of the present disclosure, an open door D is a door that is opened to a desired position, likely greater than about 30 degrees and up to about 90 degrees, but perhaps greater than 90 degrees.

Figure 2:
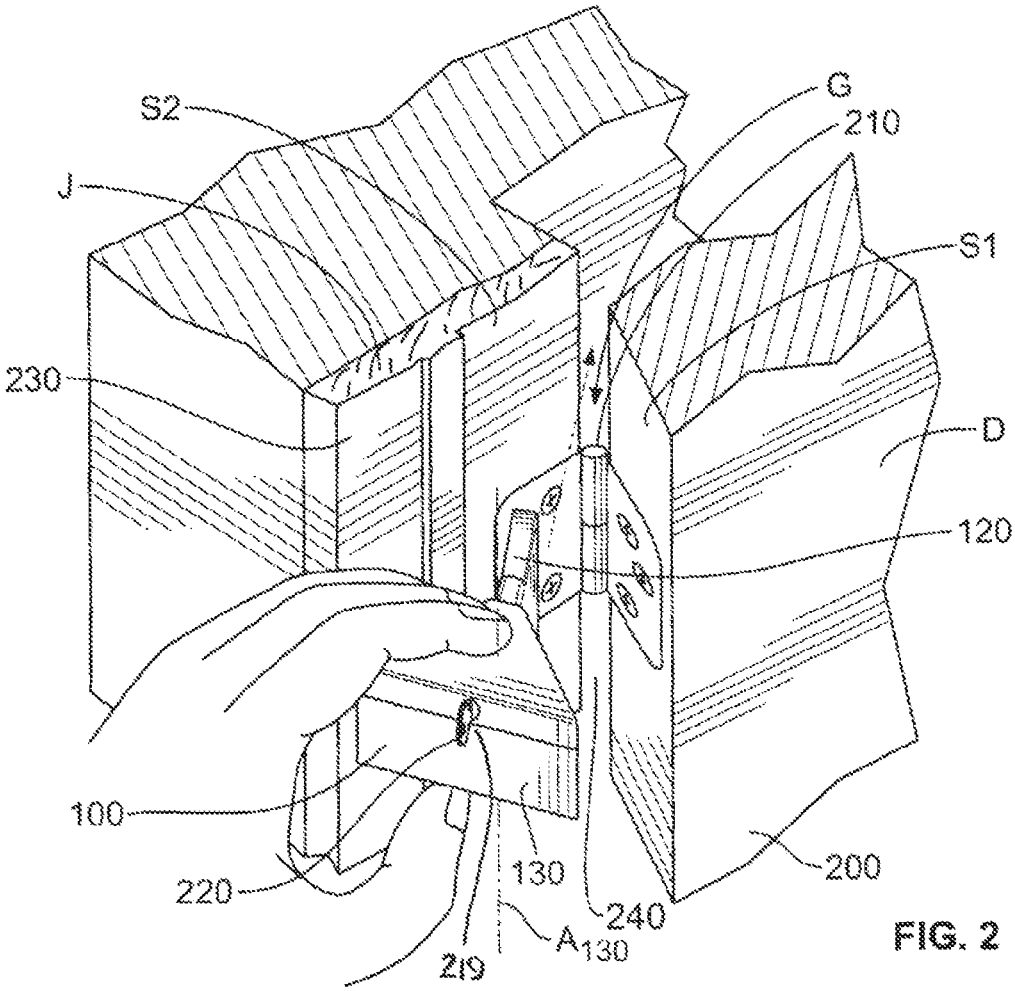
FIG. 2 illustrates the door stop of FIG. 1 ready for insertion between a door and door jamb, into the acute angle formed between the door and jamb.
Figure 5:
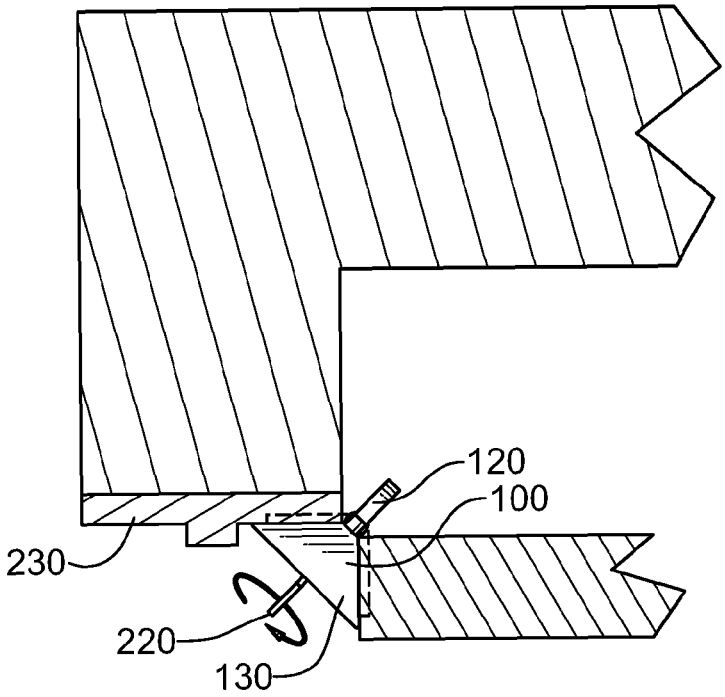
FIG. 5 is an elevational view illustrating the door stop positioned between the door and jam and in the un-locked position.

The wedge-shaped body 130 sides 132, 134 which are formed at an angle $\alpha$ to one another define an apex or converging end 136. The body 130 also defines a longitudinal axis $A_{130}$, which, as seen in FIGS. 1 and 2, is the axis that is aligned with the door hinges 210. The rotating toggle 120 is mounted to body 130 at about the apex or converging end 136 and rotates between an insertion position (see, for example, FIG. 5) and a locked position (see, for example, FIG. 6). In an embodiment, the toggle 120 also has a generally wedge-shaped body 121 with sides 138, 140 that define an apex 139 and a longitudinal axis $A_{120}$, which extends along the long side of the body 121. The converging end 142 of the toggle 120 is proximal to the door stop body apex 136. The toggle 120 is rotatable such that the toggle 120 and body 130 oppose one another in the locked position (FIG. 6) and so that they are transverse to one another in another position, the insertion stop position (FIG. 5).

As illustrated in FIG. 2, in an embodiment, the door stop 100 can also include a lock and key assembly 219 mounted within the body 130. The key 220 in the lock can mimic the orientation of the rotating toggle 120. That is, as seen in FIG. 2, both the rotating toggle 120 and the key 220 in the lock and key assembly 140 are shown in the vertical or insertion position. The toggle 120 is mounted to the lock and key assembly 140 by a stub 148 extending between the assembly 219 and the toggle 120.

Figure 3:
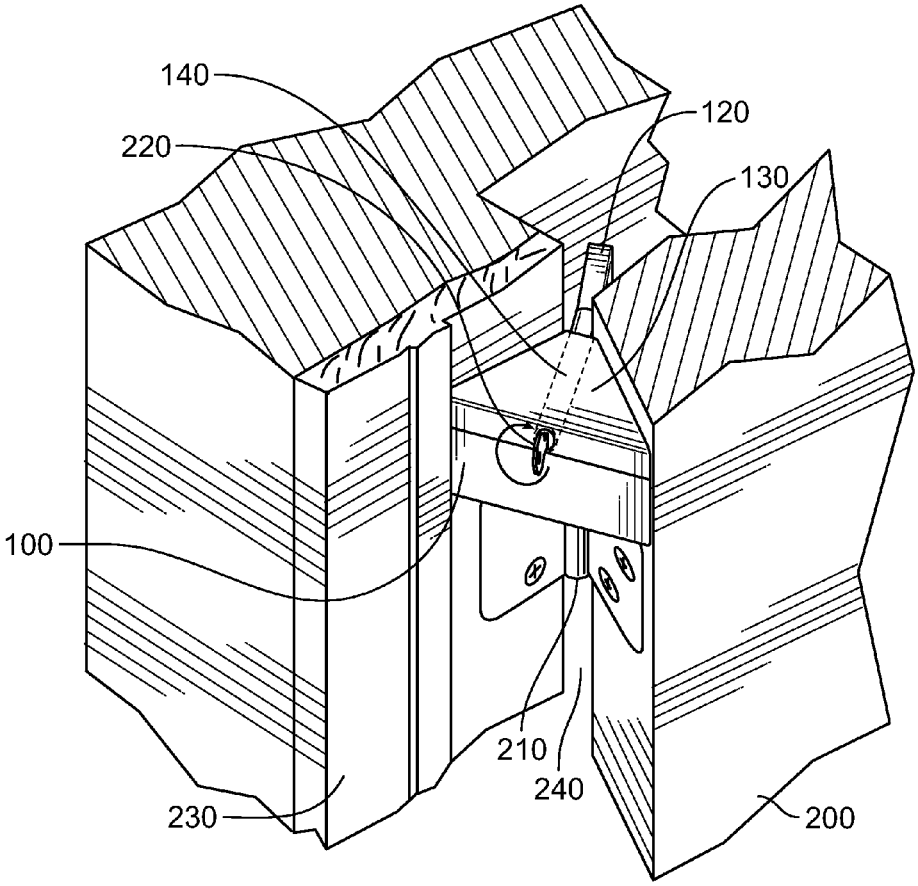
FIG. 3 illustrates the door stop of FIG. 2 inserted between the door and jamb.

To insert the door stop 100 between the door D and the jamb J, the door D is first opened sufficiently to insert the door stop 100. As seen in FIG. 3, with the toggle 120 in the insertion position, the door stop 100 is inserted into the gap G between the door D and jamb J, preferably above one of the door hinges 210, such that the toggle 120 is behind the door D and jamb J. The sides 132, 134 of the wedge-shaped body 130 are positioned on the inside door and jamb surfaces S1, S2.

Figure 4:
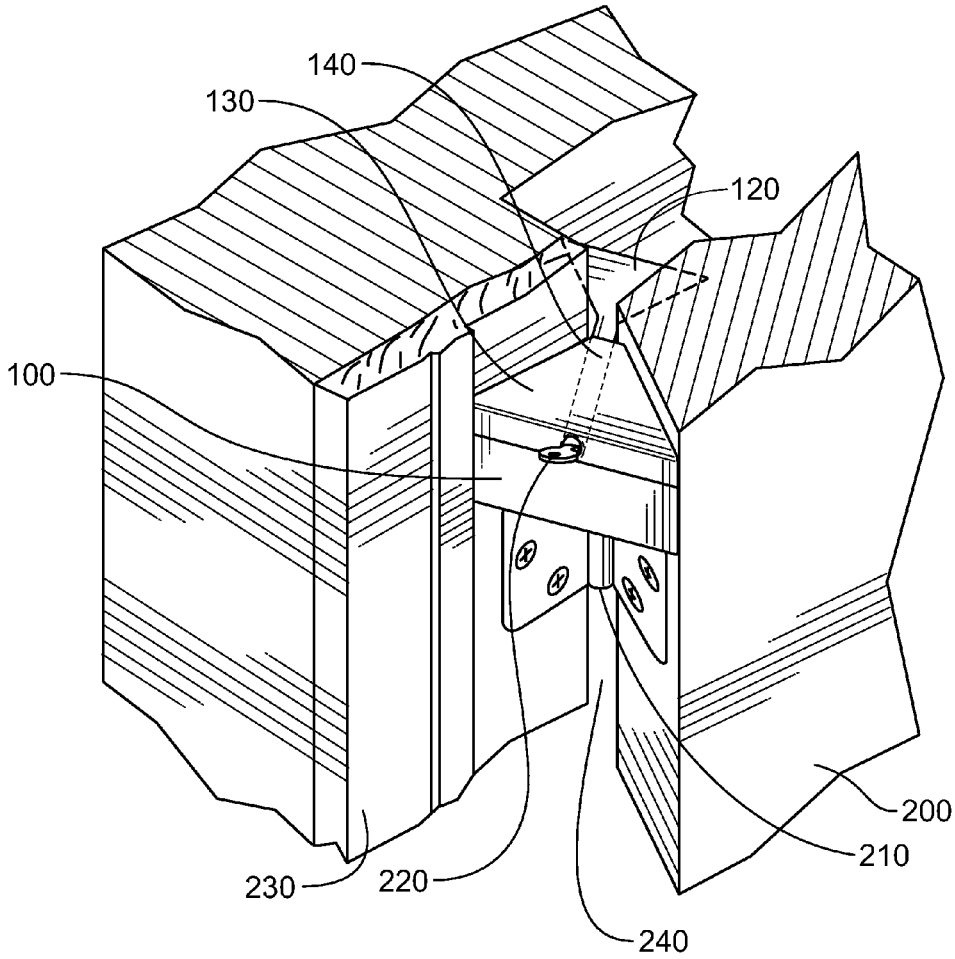
FIG. 4 illustrates the door stop in a locked position between the door and jamb, and relative to a hinge of the door structure.
Figure 6:
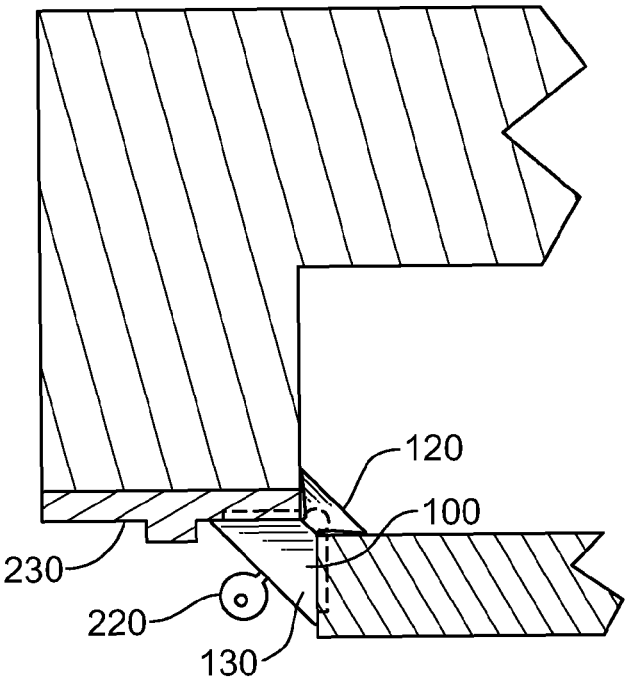
FIG. 6 is a view similar to FIG. 5 with the door stop in the locked position.

The key 220 is then turned, which in turn rotates the toggle 120 to the locked position as seen in FIGS. 4 and 6. Once the rotating toggle 120 is in a horizontal or "locked" position it locks behind the door D securing the door stop 100 within the door jamb J, with the stem portion of the toggle (or stub 148) traversing through the door jamb gap G. This anchors the door stop 100 in place. And, with the key 220 in the lock and key assembly 140 rotated to a horizontal position, this correspondingly rotates and locks the rotating toggle 120 to the locked or horizontal position. The key 220 can be removed from the lock and key assembly 140 and the rotating toggle 120 will remain in the locked position. In this manner, the door stop 100 cannot be removed from the door jamb gap G and as such the door D will remain in an open condition.

If a person tries to close the door D while the door stop 100 is in the horizontal or locked position, the toggle 120 (located behind the door D within the door jamb gap G), prevents the door stop 100 from being removed and thus the door D from closing. As noted above, the door stop 100 rests on top of the door hinge 210 so that the rigid door hinge 210 can support the pressure and avoid damage to both the door D and the door jamb J.

To remove the door stop 100, the user reinserts the key 220 into the lock and key assembly 140 and rotates the key 220 in the opposite direction so that both the key 220 and the rotating toggle 120 rotate to a vertical or insertion position (which, it will be understood, is also a removal position) allowing the door stop 100 to be removed from the door jamb J.

It should be appreciated that locking systems other than the illustrated key lock can be used in the present door stop. For example, as a combination lock, a U-lock, an electronic lock and the like can be used to lock the door stop 100 in place in the door jamb J.

Figure 7:
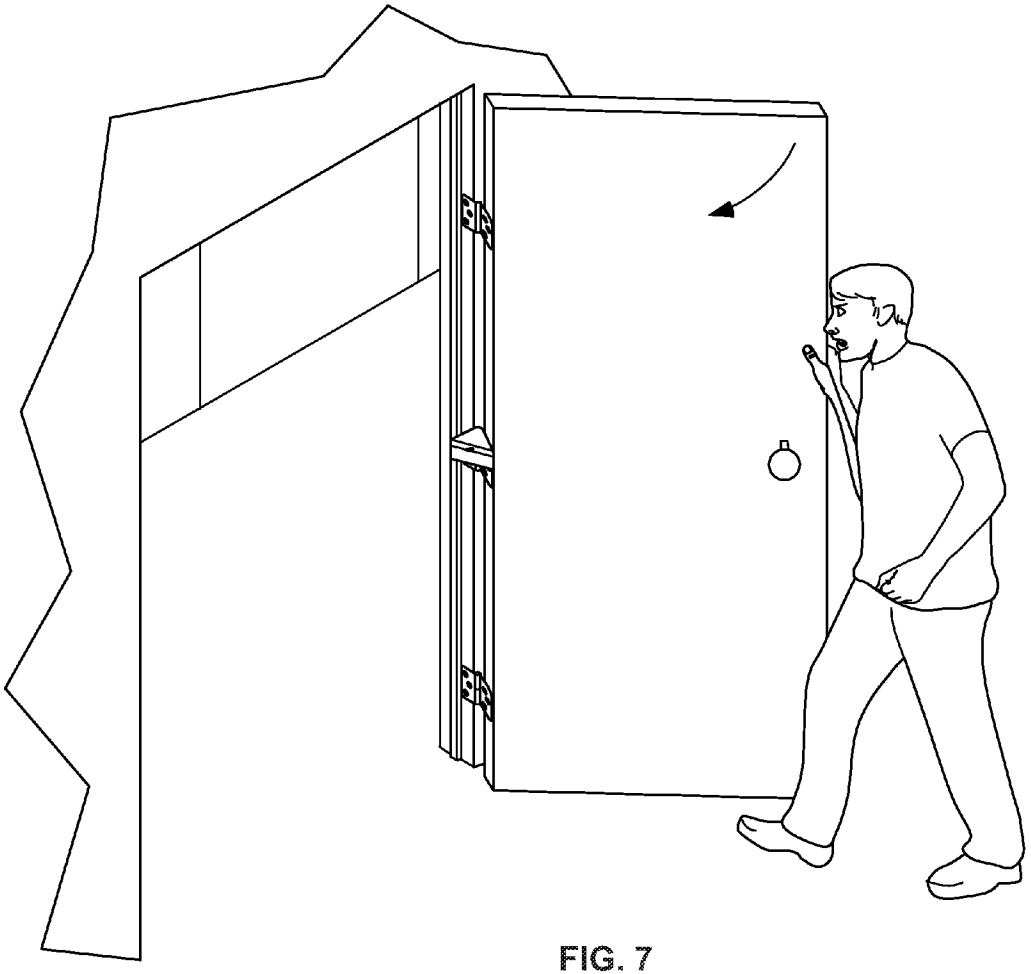
FIG. 7 is an illustration of an open door with the door stop positioned between the door and jamb, relative to a door hinge.
Figure 8:
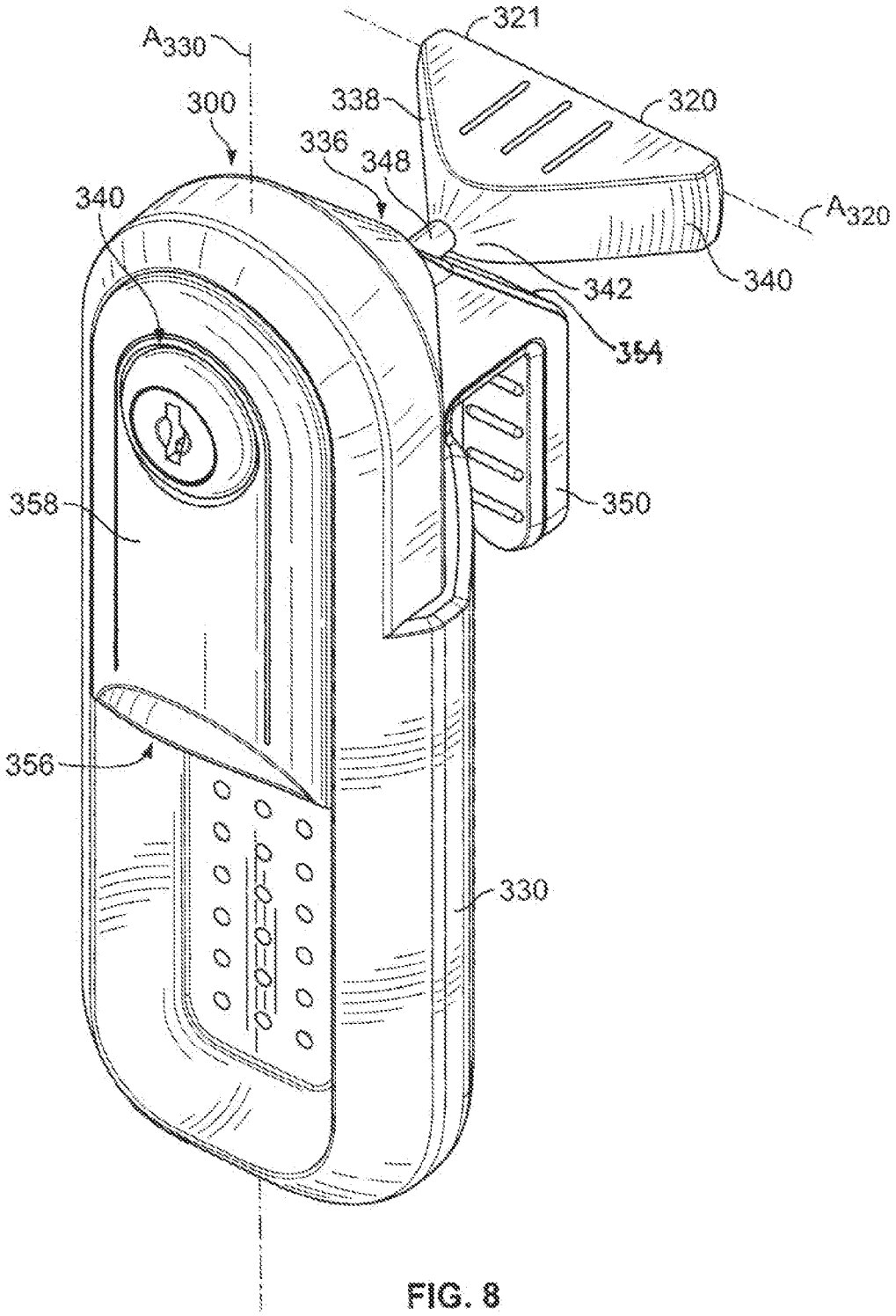
FIG. 8 is a top perspective view of an alternate embodiment of the door stop.

FIGS. 5 and 6 are elevational views of the door stop 100 with the lock and key assembly 140 (and key 220) and rotating toggle 120 in the insertion (or removal) position and in the locked position, respectively. As illustrated in FIG. 7, once the key 220 is turned to a horizontal position and the rotating toggle 120 is turned to a horizontal or locked position and the key 220 is removed from the lock and key assembly 140, the door stop 100 stays securely inserted within the door jamb gap G and the door D cannot be forced closed. This prevents a person from forcibly closing the door D and locking the door D when the door is meant to remain in an open condition (e.g., for security purposes, safety concerns, or the like).

Figure 9:
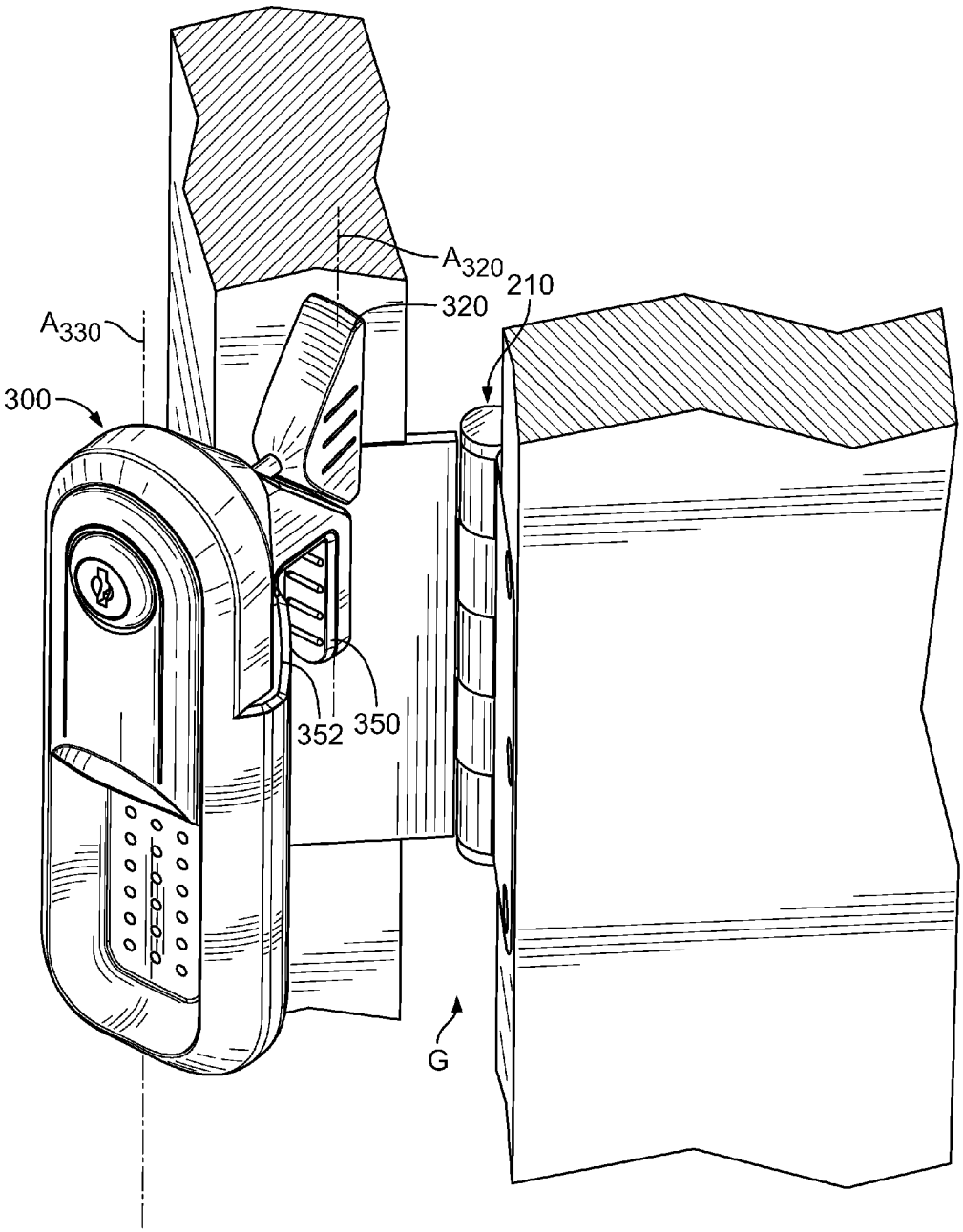
FIG. 9 is a view of the door stop similar to FIG. 8, showing the door stop in the insertion position with the toggle aligned with the door stop body and hook, prior to insertion into the door jamb.
Figure 10:
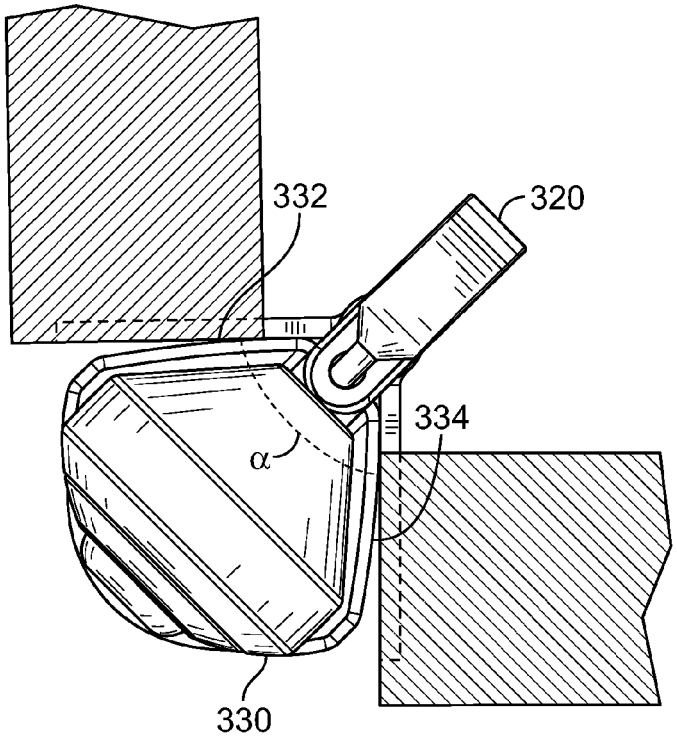
FIG. 10 is a top view of the door stop in the insertion position in the door jamb.
Figure 11:
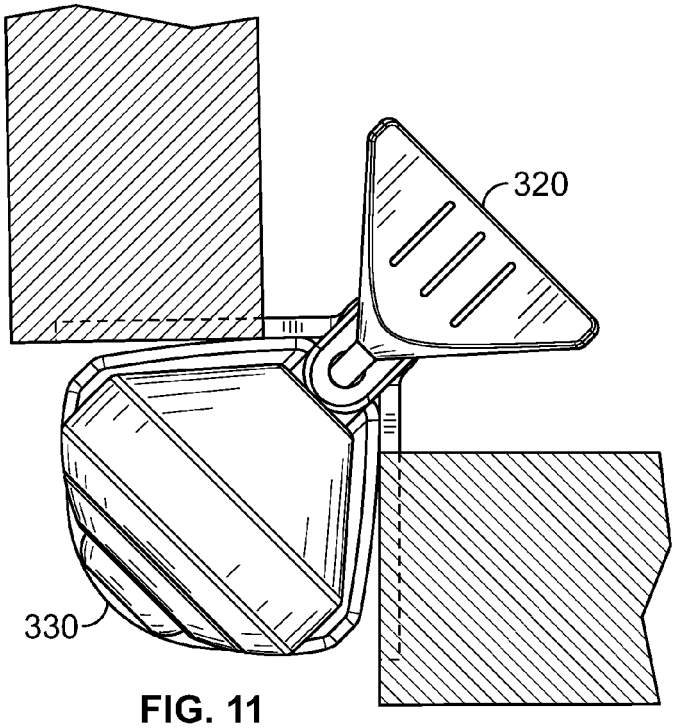
FIG. 11 is a top view of the door stop in the door jamb, in the locked position.

An alternate embodiment of the door stop 300 is illustrated in FIGS. 8-11. This ergonomically friendly embodiment includes a wedge-shaped body 330 having a pair of sides 332, 334 formed at an angle $\alpha$ to one another. The sides 332, 334 are formed at an angle $\alpha$ to one another to define an apex 336 or converging end. As best seen in FIGS. 10 and 11, the sides 332 and 334 can have a slightly outwardly bowed or curved shape to facilitate a smooth and proper engagement of the door stop 300 with the door D and jamb J, and to avoid damage to the door stop 300, and possibly the door D and jamb J in the event that the angle or dimensions/tolerances are not precise.

The body 330 also defines a longitudinal axis $A_{330}$, which, as seen in FIG. 9, is the axis that is aligned with the door hinge 210. The rotating toggle 320 is mounted to body 330 at the body apex 336 and rotates between an insertion position and a locked position.

The toggle 320 also has a generally wedge-shaped body 321 defining sides 338, 340 that define an apex 342 and a longitudinal axis $A_{320}$, which extends along the long side of the body 321. The apex 342 of the wedge 321 is proximal to the door stop body apex 336. As with the previous embodiment, the toggle 320 is rotatable such that the toggle 320 and body 330 oppose one another (the wedge-shaped bodies oppose one another in the locked position). In this embodiment the toggle is aligned with the body in one position, the insertion position (FIG. 10), and is transverse to the body in another position, the lock position (FIG. 11).

A lock assembly 340 is positioned in the body 330. The lock assembly 340 can be of a key-type lock, as illustrated. The lock assembly 340 is mounted to the toggle 320 by a stub 348 extending between the lock assembly 340 and the toggle 320. Again, rotating the key (not shown) in turn rotates the toggle 320 between the insertion and locked positions. Lock types other than a key, e.g., a combination lock, a U-lock, electronic lock and the like can be used.

In this embodiment, the body 330 includes a hook 350 extending from a rear portion 352 of the body 330 (at about the apex 336). In the illustrated embodiment, the hook 350 extends from the body 330, below the toggle 320. The hook 350 is configured so as to not interfere with rotation of the toggle 320. Again, as illustrated, the hook 350 is formed in the body 330, adjacent to and below the toggle 320, and has a sloping surface or cut-out as illustrated at 354 to accommodate the toggle 320 in the insertion (and removal) position. It has been found that the hook 350 reduces the stresses on the toggle 320, stub 348 and lock assembly 340 by the weight or force of the door D, and thus shifts most if not all of such stresses and/or forces on to the hook 350. As such, the hook 350, which can be formed as part of or mounted to the body 330, can be formed from a suitable material, such as a reinforced resin to withstand such forces/stresses.

This embodiment can also include a holding region as indicated at 356, such as the region formed between a cover 358 and the body 330. The holding region 356 which is defined by a concave recess in the body 330 and opposing convex cover 358, provides a place for a user to insert one or more fingers when inserting or removing the door stop 300 from the door jamb J. The holding region 356 provides the user with a secure place for the user's fingers when inserting or removing the door stop 300.

As to the manner and usage and operation of the door stop 100, 300, the same should be apparent from the above disclosure, and accordingly no further discussion relative to the manner of usage and operation is provided.

With respect to the above description then, it is to be realized that the optimum dimensional relationships for the parts of the door stop, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present disclosure.

It will also be appreciated by those skilled in the art that the relative directional terms such as sides, upper, lower, rearward, forward and the like are for explanatory purposes only and are not intended to limit the scope of the disclosure.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present disclosure. It is to be understood that no limitation with respect to the specific embodiments illustrated is intended or should be inferred. The disclosure is intended to cover all such modifications as fall within the scope of the claims.

The invention claimed is:

1. A door stop, comprising:

a body having a longitudinal axis and having angled sides defining an apex;

a rotating toggle having angled sides defining an apex, the toggle defining a longitudinal axis, the toggle operably connected at its apex to the body at about the apex of the body, the toggle rotatable such that the longitudinal axis of the toggle aligns with the longitudinal axis of the body in an insertion position and such that the longitudinal axis of the toggle is transverse to the longitudinal axis of the body in a locked position; and a lock assembly operably mounted to the body to lock the toggle in the locked position.

2. The door stop of claim 1 wherein the lock assembly is mounted within the body.

3. The door stop of claim 2 including a stub extending between and connecting the lock assembly and the toggle.

4. The door stop of claim 3 wherein the stub extends from the apex of the body to the apex of the toggle.

5. The door stop of claim 1 wherein lock assembly includes a key lock having a key.

6. The door stop of claim 5 wherein the key is removable from the key lock.

7. The door stop of claim 1 wherein the lock assembly is configured to lock the toggle in the locked position.

8. The door stop of claim 5 wherein the key is rotatable to rotate the toggle.

9. The door stop of claim 1 including a hook extending from a rear of the body, the hook configured to cooperate with a hinge mounting a door to a door frame.

10. The door stop of claim 9 wherein the hook includes a cut-out to accommodate the toggle when the toggle is in the insertion position.

11. The door stop of claim 1 including a holding region formed on a front of the body.

12. The door stop of claim 11 wherein the holding region is defined between a cover and the body.

13. The door stop of claim 10 including a holding region formed on a front of the body opposite the hook, the holding region defined between a cover and the body.

* * * * *